US005608942A

United States Patent [19]

Disbrow

[11] Patent Number: 5,608,942

[45] Date of Patent: Mar. 11, 1997

[54] MOP WRINGER

[76] Inventor: Richard Disbrow, 24 Linda Pl., Denville, N.J. 07834

[21] Appl. No.: 253,313

[22] Filed: Jun. 3, 1994

[51] Int. Cl.[6] ..... A47L 13/59

[52] U.S. Cl. ..... 15/261; 4/661; 4/666; 100/132

[58] Field of Search ..... 15/260–263; 4/661, 4/666; 68/235 D, 241, 276; 100/132; 248/231.5

[56] References Cited

U.S. PATENT DOCUMENTS

| | | | |
|---|---|---|---|
| 238,764 | 3/1881 | Crooker et al. | 68/276 |
| 456,666 | 7/1891 | White | 15/261 |
| 697,223 | 4/1902 | Towne | 15/261 |
| 698,773 | 4/1902 | White | 15/261 |
| 1,434,534 | 11/1922 | Eiffe | 15/261 |
| 2,229,510 | 1/1941 | Lawlor | 15/262 |
| 2,275,461 | 3/1942 | Palmer | 15/261 |
| 2,808,594 | 10/1957 | Hodgson | 68/241 |
| 3,914,988 | 10/1975 | Avoy | 68/241 |

FOREIGN PATENT DOCUMENTS

| | | | |
|---|---|---|---|
| 499619 | 11/1954 | Italy | 15/261 |

*Primary Examiner*—Mark Spisich
*Attorney, Agent, or Firm*—Thomas L. Adams, Esq.

[57] ABSTRACT

A mop wringer is adapted for mounting on the rim of a basin or toilet bowl. The wringer has a pressure plate with a lower edge. The wringer also has a mounting frame with a lower receptacle for receiving the lower edge of the pressure plate. The frame also has an upper receptacle adapted to fit onto the rim of the basin or bowl. The pressure plate is mounted on the mounting frame for compressing a mop between the pressure plate and the mounting frame. The mounting frame has a lug projecting on the mounting frame away from the pressure plate. This lug is above the lower receptacle and below the upper receptacle when the wringer is mounted on the basin or bowl.

20 Claims, 3 Drawing Sheets

MOP WRINGER

BACKGROUND OF THE INVENTION

1. Field of the Invention

The present invention relates to mop wringers, and in particular, to wringers having a mounting frame for attaching the wringer to various devices.

2. Description of Related Art

Mop wringers are typically mounted on a pail of water. Moving the wringer and pail can be difficult because of the weight of the water and its tendency to spill.

In U.S. Pat. No. 980,710 a wringer is shown with slots having a wide and narrow upper portion. The different widths allow the wringer to fit on either a wooden or metal pail or a tub. See also U.S. Pat. No. 651,518.

In U.S. Pat. No. 1,452,798, a mop wringer has a leg that projects against the inside surface of a pail. The projecting leg, however, does not accommodate mounting the wringer on various fixtures such as a basin or a toilet bowl. See also U.S. Pat. Nos. 3,452,379; 4,047,261; and 5,070,574.

Accordingly, there is a need for a mop wringer that is highly adaptable and may be mounted on various items such as a basin, or a toilet bowl to facilitate mopping without the need to carry a pail of water from room to room.

SUMMARY OF THE INVENTION

In accordance with the illustrative embodiments demonstrating features and advantages of the present invention, there is a provided a mop wringer adapted for mounting on a rim of a basin or toilet bowl. The mop wringer has a pressure plate with a lower edge and a mounting frame with a lower receptacle. This lower receptacle can receive the lower edge of the pressure plate. The mounting frame also has an upper receptacle adapted to fit onto the rim of the basin or bowl. The pressure plate is mounted on the mounting frame for compressing a mop between the pressure plate and the mounting frame. This mounting frame has a lug projecting on the mounting frame away from the pressure plate. This lug is above the lower receptacle and below the upper receptacle when the wringer is mounted on the basin or bowl.

By employing such apparatus, an improved mop wringer is achieved. In a preferred embodiment, a pressure plate is hingedly attached to the lower edge of a mounting plate. This mounting plate connects to a backer plate to form an inverted U-shaped structure adapted to fit over a basin or a toilet bowl. In this preferred embodiment, the junction between the mounting frame and the backer plate is a channel sized to fit over the rim of a toilet bowl. The roof of the channel is broached by a groove that is sized to fit over the rim of a basin. Thus this single mop wringer is adapted to fit over the rim of two very different structures.

To facilitate mounting on a toilet bowl, the mounting frame has a lug that is designed to fit under the lip on the rim of the toilet bowl. Preferably, the lug is retractable so that the mounting frame can be easily fitted onto the rim of the toilet bowl by simply retracting the lug.

In the preferred embodiment, the lug is a lower projection on a pair of arms pivotally attached to the mounting frame. The upper ends of the arms are spanned by a grip that lies alongside a handle mounted to the top of the mounting frame. By squeezing the handle and grip together, the arms rotate to retract the lug and allow easy mounting or dismounting of the mop wringer.

Preferably, the backer plate is recessed on top while the mounting frame is recessed on the bottom to provide an interspace that is adapted to fit around the typically curving wall of a toilet bowl. The preferred wringer also has a knee recess on the outside of the backer plate. This allows the user to brace the mop wringer from movement with a knee, while pulling the pressure plate to squeeze a mop.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figure 1:
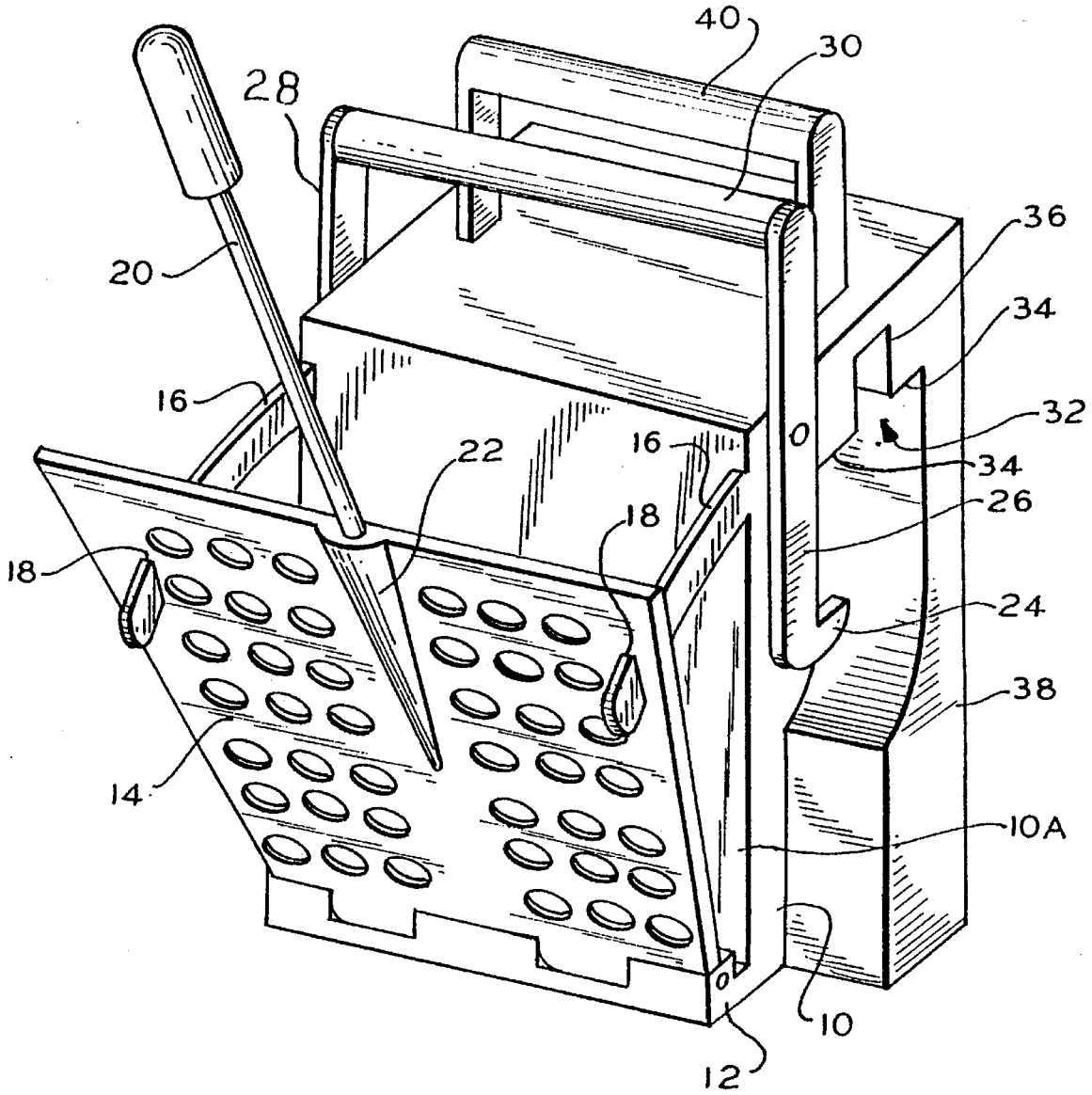
FIG. 1 is an axonometric view of a mop wringer in accordance with the principles of the present invention.
Figure 2:
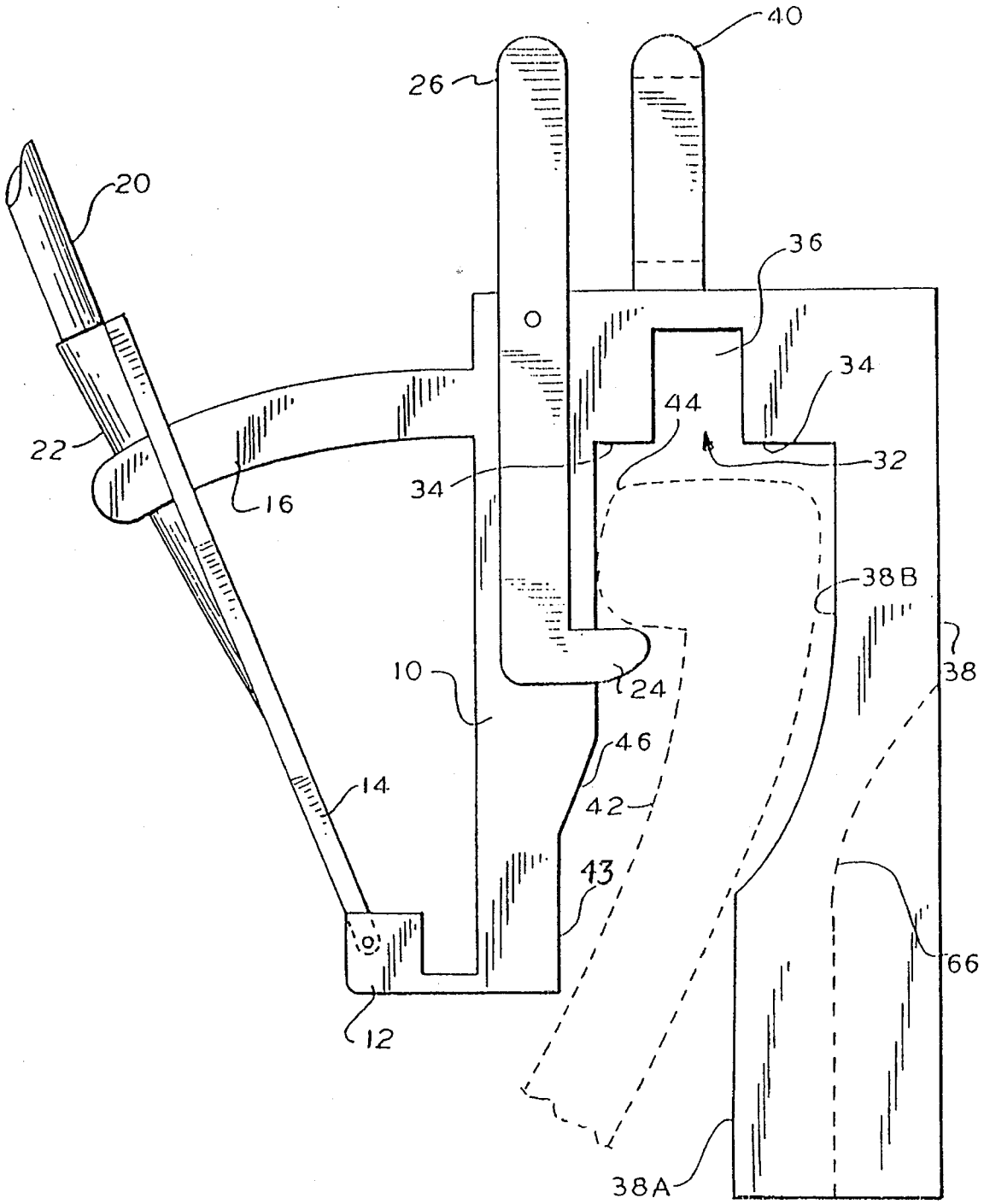
FIG. 2 is a side view of the wringer of FIG. 1.

Referring to FIGS. 1 and 2, a mop wringer is shown with a mounting frame 10 in the form of a molded plastic item whose lower edge is formed into a J-shaped, lower receptacle 12. Receptacle 12 extends beyond the face 10A of frame 10 by 2 inches (5.08 cm). The terminal edge of receptacle 12 is notched and hingedly interdigitates with a pressure plate 14, shown herein as a molded, perforated, plastic plate having a generally trapezoidal outline with the upper edge wider than the lower edge. The lower edge of plate 14 can be attached to receptacle 12 by a pin or by appropriate ball and socket joints.

The face 10A of frame 10 facing pressure plate 14 is generally flat except for two arcuate, parallel guide bars 16. Guide bars 16 fit through slots 18 in pressure plate 14. Guide bars 16 provide a degree of lateral stability to pressure plate 14.

Lever 20 is secured in a bore formed in an embossment 22 in pressure plate 14. Lever 20 is 5 inches (12.70 cm) long while pressure plate 14 is 9 inches (22.86 cm) tall. Lever 20 may be formed of a metal tube, a plastic rod, or other material and can be secured in embossment 22 by glueing, screwing, riveting, etc.

A retractable lug, shown herein as a catch 24, is mounted integrally to the lower end of L-shaped arm 26. A complementary arm 28 is shown mounted on the opposite side of frame 10. Arms 26 and 28 are pinned to frame 10 to pivot near its upper edge. The upper ends of arms 26 and 28 are connected together at by a spanning grip 30. As described further hereinafter, catch 24 is designed to fit under the lip of a toilet bowl rim and for this reason is spaced preferably 2½ inches (6.35 cm) from the surfaces 34. In its normal position, catch 24 extends away from frame 10 by 1 inch (2.54 cm).

A backer plate 38 is integrally molded with mounting frame 10 to form between them a channel 32, also referred to as an upper receptacle. Backer plate 38 is 12 inches (30.48 cm) high and extends 2 inches (5.08 cm) below the lower edge of mounting frame 10. Receptacle 32 is a channel bordered by two horizontal flat surfaces 34 broached by a rectangular groove 36. As described hereinafter, the channel 32 is sized to fit the rim of a toilet bowl while groove 36 is sized to accommodate the rim of a basin. The top of channel 32 is preferably 2⅝ inches (6.67 cm) wide, while groove 36 is preferable 1½ inches (3.81 cm) tall and 1¼ (3.18 cm) inches wide. The overall thickness of the assembly including frame 10 and backer plate 38 is 6 inches (15.24 cm). A carrying handle 40 is mounted atop frame 10 above groove 36.

The vertical interior face 38A of backer plate 38 has a recessed portion 38B proximal the upper receptacle 32. Recessed portion 38B comprises an upper vertical wall descending to a curved transition. The surface of mounting frame 10 facing backer plate 38 has a recessed portion 43 shown as a vertical flat surface intersecting at an obtuse angle a flat transition surface 46. These recesses in the interior faces of frame 10 and backing plate 38 provide a complex channel adapted to receive toilet bowl rims of various sizes and shapes. One such toilet bowl rim is shown herein in phantom as rim 42 having an inwardly directed lip 44.

Alternatively, groove 36 is adapted to receive the relatively narrow rim of a basin. Adequate clearance is provided in that the interior surface 38A is coplanar with an outermost interior surface of groove 36 to avoid interference.

Figure 3:
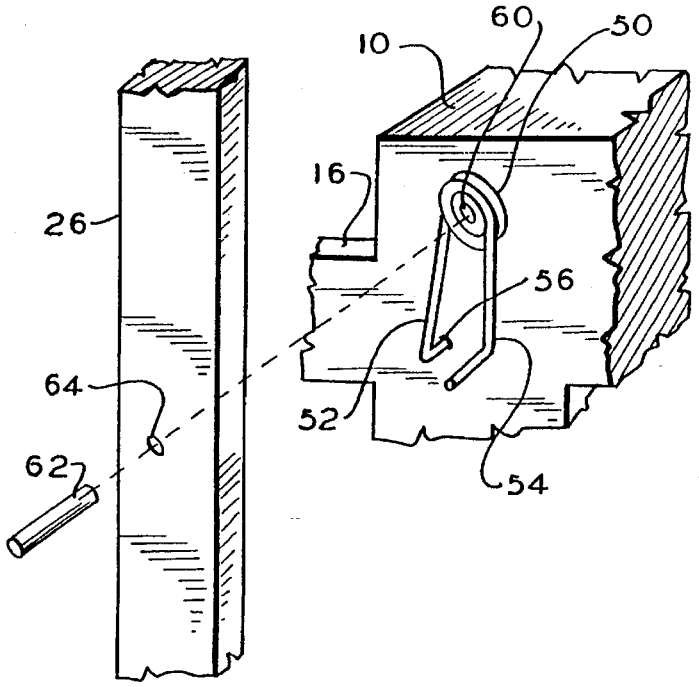
FIG. 3 is an exploded view of the joint between the lug arm and mounting frame of the wringer of FIG. 1.
Figure 4:
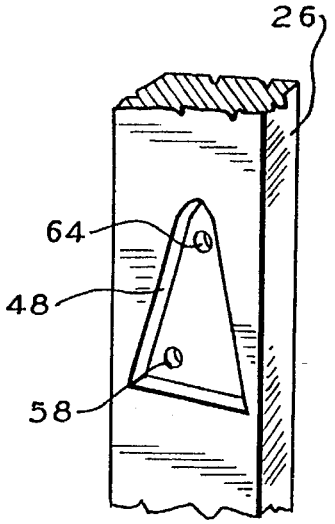
FIG. 4 is a reverse, axonometric view of the lug arm of FIG. 3.

Referring to FIGS. 3 and 4, the joint between mounting frame 10 and lug arm 26 is shown in a detailed, exploded view. Arm 26 has an interior cavity 48 having a generally triangular outline but with a rounded vertex. Cavity 48 is designed to hold a helical torsion spring 50. The coil of spring 50 is to be positioned concentrically about bore 60 so that a pivot pin 62 can fit through bore 64 and into bore 60. Spring 50 terminates in L-shaped arms 52 and 54. Arm 52 is designed to fit into a bore 56 in frame 10 while arm 54 is designed to fit into a bore 58 in the cavity 48 of arm 26. With the spring arms fitted into those bores, the lug arm 26 can overlay and conceal spring 50 inside cavity 48. Arranged in this fashion, arm 26 is urged to rotate counterclockwise (as viewed in FIG. 3).

Figure 5:
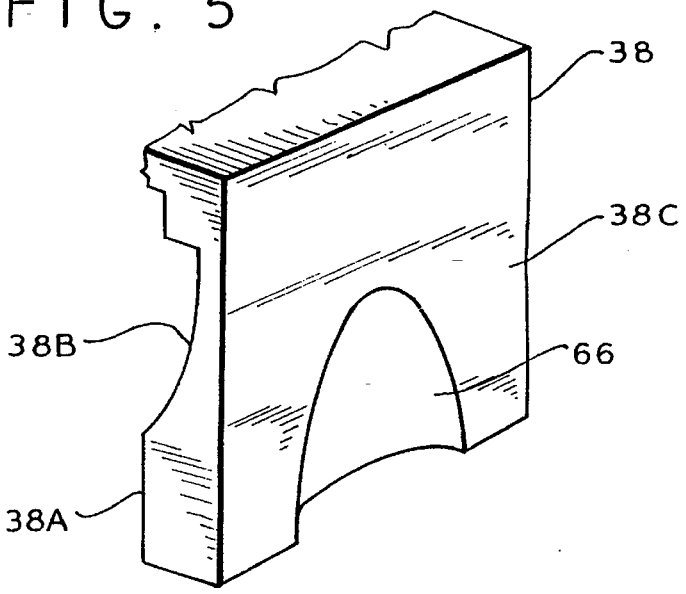
FIG. 5 is a reverse, axonometric view of the backer plate of the wringer of FIG. 1.

Referring to FIGS. 2 and 5, the external face 38C of backer plate 38 has formed therein an external recess 66. Recess 66 is a section of an ovoid. As described further hereinafter, recess 66 can be used to cradle a knee used to brace the wringer when in use.

To facilitate an understanding of the principles associated with the foregoing apparatus, its operation will now be briefly described. The wringer may be carried by handle 40 to a room having a basin or a toilet bowl. If a basin is available, the user will place the rim of the basin into groove 36 to hold the wringer upright.

If a toilet bowl is to be used instead, the operator will squeeze together grip 30 and handle 40 (FIG. 1). Consequently, arm 26 will rotate to retract catch 24 and wind torsion spring 50 (FIG. 3). With catch 24 retracted, no obstruction exists to impede movement of the relatively thick rim 44 (FIG. 2) of toilet bowl 42. Rim 44 therefore moves easily into the space underlying surfaces 34 in channel 32.

Once the toilet bowl rim 44 is positioned as shown in FIG. 2, grip 30 can be released so that torsion spring 50 (FIG. 3) relaxes and drives arms 26 and 28 apart so that catch 24 fits under the underside of toilet bowl rim 44 as shown in FIG. 2. Tipping the wringer was unnecessary before fitting the wringer onto the toilet bowl rim.

At this time, a mop (not shown) may be immersed in the toilet bowl 42 before mopping a floor. When needing wringing, the mop is placed between pressure plate 14 and the external face 10A of frame 10. Thereafter, the user grabs the end of lever 20 and draws it toward frame 10. At this time, the operator can place a knee into recess 66 to brace the wringer and prevent it from lifting or moving off the toilet bowl rim.

When the wringer is no longer needed at this site, the operator can simply remove the wringer by seizing simultaneously the grip 30 and handle 40 and squeezing them together. Consequently, catch 24 will retract and release the underside of lip 44 of toilet bowl 42. Then with one motion the operator can lift the wringer from the toilet bowl and carry just the wringer without a pail to the next mopping site.

It is to be appreciated that various modifications may be implemented with respect to the above described preferred embodiment. While the preferred embodiment is constructed primarily of molded plastic, some embodiments may employ components made of metal, wood, ceramic, etc. While a hinged pressure plate is illustrated, in other embodiments, a lever or other device may be used to press the pressure plate against the mounting frame without rotating. Also, the backer plate need not be a continuous plate but may employ instead one or more narrow arms to hold the mounting frame in position. In addition, the space between the backer plate and mounting frame can have various angled or curved surfaces other than those shown to accomplish similar results. Furthermore, the dimensions and shape of that interspace can be adjusted depending upon the expected type of basin or bowl. Furthermore, some embodiments will not require the guide arms shown herein to stabilize laterally the pressure plate. Also, in some embodiments the rim catch may be a simple fixed ridge designed to fit under the lip of a toilet bowl. Still, in embodiments employing a retractable catch or lug, the retracting feature may be achieved by alternate mechanisms including a spring-loaded slide that can snap over the toilet bowl lip and has such angled surfaces that the lug can be released simply by vigorously lifting the wringer. Alternatively, various kinds of operating mechanisms can be employed to actively retract the catch. Also while the upper receptacle is shown with a flat underside broached by a rectangular groove, some embodiments may use curved surfaces or polyhedral surfaces of various types. Furthermore, the various dimensions and shapes can be altered depending upon the desired capacity, strength, and the expected size and shape of the bowl or basin.

Obviously many modifications and variations of the present invention are possible in light of the above teachings. It is therefore to be understood that within the scope of the appended claims, the invention may be practiced otherwise than as specifically described.

I claim:

1. A mop wringer adapted for mounting on a rim of a basin or toilet bowl comprising:

a pressure plate having a lower edge;

a mounting frame having a lower receptacle for receiving the lower edge of said pressure plate and an upper receptacle adapted to fit onto the rim of the basin or bowl, said upper receptacle has a channel sized to receive the rim of a bowl, said channel being broached by a narrower groove sized to fit the rim of a basin, said pressure plate being mounted on said mounting frame for compressing a mop between said pressure plate and said mounting frame, said mounting frame having a lug projecting from said mounting frame away from said pressure plate such that it is adapted to fit under an inner lip of a bowl when said mop wringer is mounted thereon, said lug being above said lower receptacle and below said upper receptacle when said wringer is mounted on the basin or bowl.

2. A mop wringer according to claim 1 wherein said lug is retractable.

3. A mop wringer according to claim 1 comprising:

means for urging said lug into an extended position.

4. A mop wringer according to claim 1 wherein said lug comprises:

an arm pivotally attached to said mounting frame.

5. A mop wringer according to claim 4 wherein said arm is L-shaped.

6. A mop wringer according to claim 1 wherein said lug comprises:

a pair of arms pivotally mounted on opposite sides of said mounting frame, said arms each having a catch projecting away from said pressure plate, said arms having a grip spanning between said arms at an end thereof distal from said catches.

7. A mop wringer according to claim 6 comprising:

a handle mounted atop said mounting frame alongside said grip, so that said grip and said handle can be squeezed together to pivot said arms.

8. A mop wringer according to claim 7 comprising:

a spring mounted at said mounting frame to urge said grip away from said handle.

9. A mop wringer according to claim 8 wherein said spring is mounted between said mounting frame and one of said arms.

10. A mop wringer according to claim 1 comprising:

a handle mounted atop said mounting frame.

11. A mop wringer according to claim 10 comprising:

a lever attached to said pressure plate for moving it against said mounting frame.

12. A mop wringer according to claim 11 wherein said lever is taller than said handle.

13. A mop wringer according to claim 1 wherein said pressure plate is hingedly attached to the lower receptacle of said mounting frame.

14. A mop wringer according to claim 13 comprising:

a spaced pair of guide bars projecting from said mounting frame and slidably coupled to said pressure plate.

15. A mop wringer according to claim 1 comprising:

a backer plate affixed to said mounting frame near its upper receptacle.

16. A mop wringer according to claim 15 wherein said backer plate has an external recess sized to cradle a knee.

17. A mop wringer according to claim 15 wherein a portion of said backer plate proximal said upper receptacle and facing said mounting frame is recessed.

18. A mop wringer according to claim 17 wherein a portion of said mounting frame distal from said upper receptacle is recessed.

19. A mop wringer according to claim 15 wherein said backer plate is longer than said mounting frame.

20. A mop wringer according to claim 1 comprising:

a lever attached to said pressure plate for moving it against said mounting frame.

* * * * *